US010895053B2

(12) United States Patent
Suarez et al.

(10) Patent No.: US 10,895,053 B2
(45) Date of Patent: Jan. 19, 2021

(54) PILE CAP CONNECTORS

(71) Applicant: Faros Design.Build.Remodel, LLC, Stratford, CT (US)

(72) Inventors: Aviel Suarez, Milford, CT (US); Oswaldo Suarez, Stratford, CT (US); Alessandro DeCarlo, Stamford, CT (US); Daniel Arena, Bridgeport, CT (US)

(73) Assignee: Faros Design.Build.Remodel, LLC, Stratford, CT (US)

( * ) Notice: Subject to any disclaimer, the term of this patent is extended or adjusted under 35 U.S.C. 154(b) by 0 days.

(21) Appl. No.: 16/400,569

(22) Filed: May 1, 2019

(65) Prior Publication Data

US 2019/0338485 A1 Nov. 7, 2019

Related U.S. Application Data

(60) Provisional application No. 62/665,848, filed on May 2, 2018.

(51) Int. Cl.
*E02D 5/22* (2006.01)

(52) U.S. Cl.
CPC ..... *E02D 5/223* (2013.01); *E02D 2250/00* (2013.01); *E02D 2300/0026* (2013.01); *E02D 2600/20* (2013.01)

(58) Field of Classification Search
CPC ..... E02D 5/223
USPC ..... 405/250–252; D8/354, 366, 380; 52/93.1, 93.2, 299, 715; 403/232.1, 234, 403/237, 262, 403, DIG. 15
See application file for complete search history.

(56) References Cited

U.S. PATENT DOCUMENTS

| | | | | |
|---|---|---|---|---|
| 1,848,085 | A * | 3/1932 | Eisenschmidt | E04G 7/02 249/219.1 |
| 3,352,120 | A * | 11/1967 | Pelzer | E02D 5/523 175/19 |
| 6,837,019 | B2 * | 1/2005 | Collie | E04B 7/063 52/489.1 |
| 6,922,967 | B2 * | 8/2005 | Collie | E04B 7/045 52/656.9 |
| 7,533,505 | B2 | 5/2009 | Henderson | |
| 9,556,581 | B2 | 1/2017 | Hale et al. | |
| 10,100,508 | B1 * | 10/2018 | Fox | E04B 1/2608 |

FOREIGN PATENT DOCUMENTS

| | | |
|---|---|---|
| CN | 204185858 U | 3/2015 |
| KR | 20110076225 A | 7/2011 |

* cited by examiner

*Primary Examiner* — Sunil Singh
(74) *Attorney, Agent, or Firm* — Dilworth IP, LLC

(57) ABSTRACT

An improved pile cap connector for connecting the top end of a driven pile, e.g., pipe pile, to a support beam or girder of a building, and/or the building proper, comprising, a cap plate, one or more lower braces secured to the underside of the cap plate to anchor the cap to the pile, two or more upper braces securable to the top side of the support plate, wherein at least one of the two or more upper braces has a length so that the brace, when secured to the cap plate, rises above the support beam or girder so that a portion of the brace lays against the building proper for fastening thereto.

9 Claims, 7 Drawing Sheets

PILE CAP CONNECTORS

The invention provides an improved pile cap connector for connecting the top end of a driven pile, e.g., pipe pile, to a support beam or girder of a building and/or the building proper, comprising, a cap plate having a top side and an underside, one or more lower braces secured to the underside of the support plate to anchor the cap to the pie, two or more upper braces for securable disposition against the top side of the support plate, wherein at least one of the two or more upper braces has a length so that the brace, when secured to the cap plate, rises above the support beam or girder so that a portion of the brace lays against the building proper for fastening thereto.

BACKGROUND OF THE INVENTION

Different regions can place different requirements on construction. For example, coastal construction requirements are different from inland construction. Flood levels, wind velocities, and wave action in coastal areas tend to make coastal flooding more damaging than inland flooding; coastal erosion can undermine buildings and destroy land, roads, utilities, and infrastructure; and high wind speeds require stronger engineered building connections. Wind-driven rain, corrosion, and decay are also frequent concerns in coastal areas.

One particular problem is flooding, another is wind. Typically, to qualify for flood insurance, the lowest floor must be elevated above the base flood elevation, i.e., the bottom of the lowest horizontal structural member supporting the lowest floor must be above this elevation. In some flood zones, an open foundation is required. Further the foundation must be deep enough to resist the effects of scour and erosion, i.e., strong enough to resist wave, current, flood, and debris forces and capable of transferring wind and seismic forces on upper stories to the ground. This requires additional attention be paid to the soundness of the connection of the walls and floor to the foundation.

Such building practices are advisable for new building construction in coastal areas, but many existing homes and buildings in coastal areas fail to meet many of the newer standards and are at risk of being rendered uninhabitable and/or ineligible for flood insurance. To remedy some of these issues, residential houses in coastal flood hazard zones need to be lifted and placed onto elevated foundations. While elevated foundations may be more common in some areas than in others, they are used to some extent in many regions.

In the art, pile cap connectors are installed on the top of a foundation pile and are used to connect the pipe pile to a support beam or girder for the house or building.

U.S. Pat. No. 9,556,581 discloses deep pile foundation construction methodology for existing homes and other buildings and for homes and buildings under construction, comprising furnishing and installing pressure grouted displacement piles ("PGD" piles) in the deep pile foundation by capping the PGD piles under low ceiling or open site conditions. Also disclosed are pile cap connectors suitable for securing retrofitted elevated foundations to homes or other buildings that have been lifted, but which can be used for open site construction as well. A detailed description of these practices is found in US Patent Application Publication Nos. US2013/0272799 and US2014/0056652.

Unlike many other pile caps, e.g., U.S. Pat. No. 7,533,505; CN 204185858; KR 20110076225, the pile cap connector of U.S. Pat. No. 9,556,581 comprises a support plate, a sleeve and a plurality of braces that anchor the support beams or girders of the building to the pile. That is, the sleeve is attached to the underside of support plate by which the pile cap connector is secured to a foundation pile, and the plurality of braces are attached to the top face of the support cap, which braces can be affixed to a support beam or girder of the building. There are several configurations of the pile cap connector provided that offer some flexibility in how it is used, however, the cap can only connect to the underlying beam or girder.

Improvements are still needed to provide an effective pile cap that is easier to use, with a design more adaptable to specific circumstances, that offers a stronger connection between the building and the pile, and which can readily be used with new construction as well as with existing buildings.

SUMMARY OF THE INVENTION

Pile cap connectors are installed on the top of a pipe pile and are used to connect the pipe pile to a support beam or girder for the house or building. The pile cap connector of the invention, also referred to herein simply as "pile cap", connects to both the support beam or girder and the building that sits atop the support beam or girder for greater support and stability. The inventive pile cap can be readily assembled in part or in total at the building site from a few easily handled parts, providing great flexibility in use.

In the present application, "support beam" and "girder" are used interchangeably; 'building proper", when used herein, is used to reinforce the difference between the support beams and girders from the rest of the building supported thereon.

Provided is a pile cap connector, or pile cap, for connecting a top end of a foundation piling, e.g., pipe pile, to both a girder for a building and to the building proper, the pile cap comprising:

i) a cap plate having a top side and an underside, ii) one or more lower braces, typically two or more lower braces, affixed to the underside of the cap plate for attaching the cap plate to the pile; and iii) two or more upper braces for securable disposition to the top side of the support plate and at least a support beam or girder, wherein at least one of the upper braces, when secured to the top side of the cap plate, has a length so that brace rises above the girder so that a portion of the brace lays against the building for fastening thereto.

That is, when fully assembled and installed in the building structure, the pile cap of the invention has a cap plate secured to one or more lower braces and to two or more upper braces, wherein the one or more lower braces are also secured to the pile, e.g., pipe pile, and each of the two or more upper braces are attached to a support beam or girder, and at least one of the upper braces is also attached to the building proper.

The upper and lower braces may comprise holes for bolts, etc., that can be used for attaching the brace to the pile, girder, building or cap plate. In many embodiments the lower and upper braces are attached to the cap plate with welds, and certain bolt holes may not be necessary, but there is no prohibition against such holes even in these cases. It should be understood that when a means of attachment is mentioned in the specification, it refers to an embodiment using that means, but that does not necessarily preclude other embodiments using alternate means, including adhesive, set screws, welding, through bolts, or the like.

DESCRIPTION

Figure 1A:
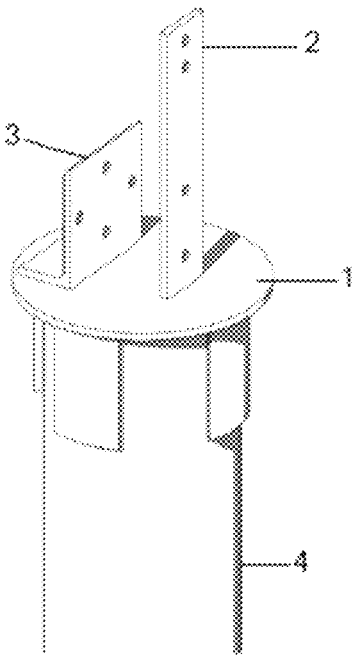
FIG. 1*a* is a view of a pile cap of the invention

One exemplary pile cap of the invention is shown in FIGS. 1*a* and *b*, with circular cap plate (1) positioned at the top of pile (4), upper braces (2) and (3) attached to the top side of the cap plate, and four lower braces (5) attached to the underside of the top plate (not all lower braces are visible).

Figure 1B:
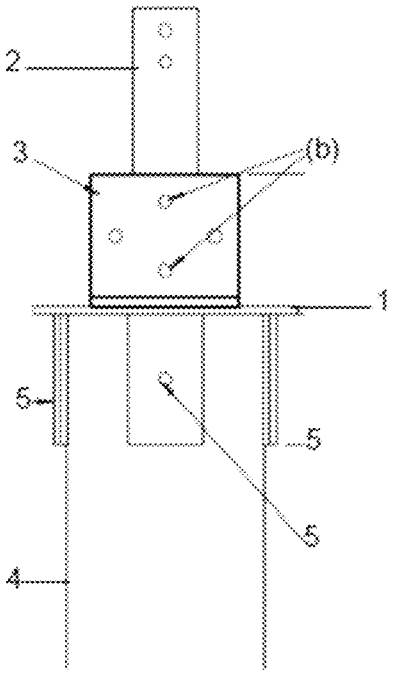
FIG. 1*b* is an alternate view of the pile cap of FIG. 1*a*

In the embodiment of FIGS. 1*a* and *b*, the lower braces (5) have holes for bolts, e.g. one is visible in FIG. 1*b*. Other fasteners may be used, but these are typically bolts. The holes in the lower braces are conveniently aligned with similar holes in the pile, and in many embodiments, aligned with complimentary holes in the opposite side of the pile and in a different brace on the opposite side of the pile. A through bolt can then be used to pass though one brace, the opposing holes in the pile, and the opposite brace. Other opposing braces, i.e., opposite each other, may also be secured by a through bolt. Through bolts provide secure anchoring to the pile, however, other embodiments can use alternate fastening means. When two or more pairs of braces are secured with through bolts, the holes for through bolting one pair of braces should be offset relative to the holes for through bolting another pair of braces, e.g., higher or lower, so that the bolts do not collide.

The lower braces are typically attached to the cap by welding but, again, other fastening means may be employed. It is possible to employ a single sleeve, as in the pile cap connector of U.S. Pat. No. 9,556,581, instead of the lower braces described above to connect the cap plate to the pile, but multiple braces, especially used in pairs offer advantages in assembly, installation etc. The lower braces may conveniently be cut from pipes of an appropriate size, e.g., steel pipes. While the embodiment shown employs 4 lower braces, other embodiments may comprise fewer braces, e.g., 2 or 3 lower braces, or more lower braces, e.g., 5, 6, 8, etc.

Figure 4A:
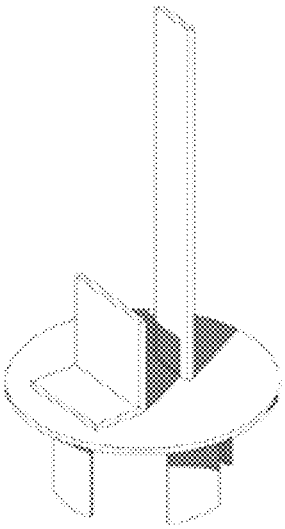
FIG. 4 compares the pile cap from above, 4*a*, to a pile cap not of the invention with only short upper braces 4*b*
Figure 4B:
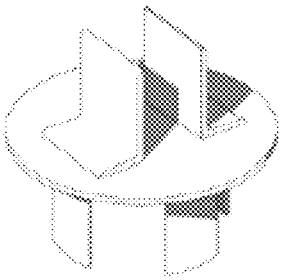
Fig. 4b (Prior Art)

In the embodiment of FIG. 1, two upper braces are shown, wherein one brace (2) is longer, or stands taller, than the other (3). That is, as shown, the longer brace (2) extends from the cap plate a distance greater than that needed to traverse the support beam or girder so that it can be attached to the house proper, while the shorter brace (3) extends no more and typically less than the distance needed to traverse the girder. In such embodiments, the shorter brace (3) is attached to the support beam or girder while the longer brace (2) is typically attached to both the support beam or girder and the building proper. FIGS. 4*a* (invention) and 4*b* (comparative) compare the structure of the present pile cap to a more conventional cap with two shorted upper braces.

Figure 5:
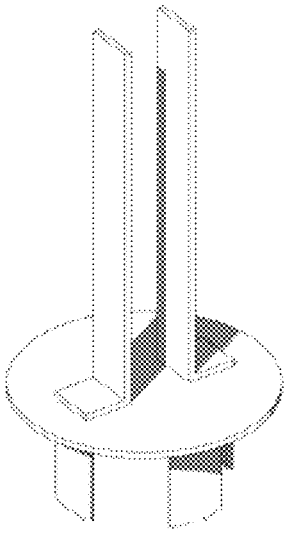
FIG. 5 shows an alternate pile cap of the invention with two long, L-shaped upper braces
Figure 6:
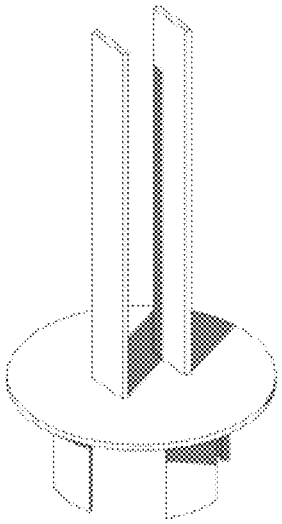
FIG. 6 shows an alternate pile cap of the invention with two long, straight upper braces

In some embodiments, as seen, for example, in FIGS. 5 and 6, more than one upper brace, e.g., all the braces, can be long enough to extend from the cap plate greater than the distance needed to traverse the support beam or girder.

Figure 2:
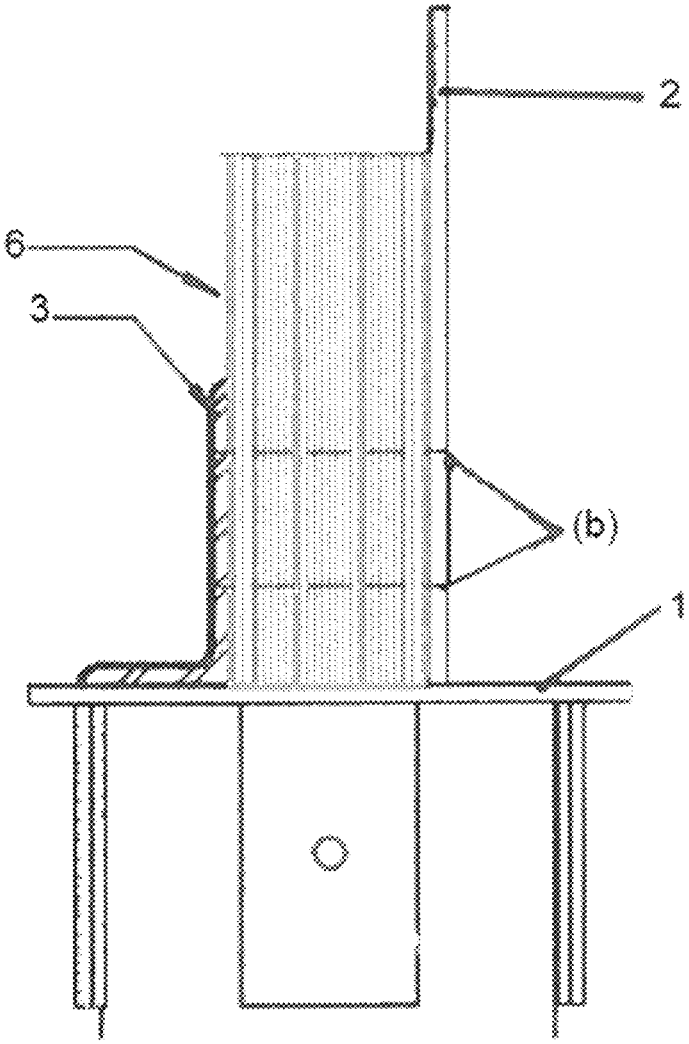
FIG. 2 shows the pile cap of FIG. 1*a* fastened to a girder atop a pile

The upper braces can comprise holes, which can be used for bolts etc., when fastening the braces to the girder or building. Possible positions for upper and lower brace holes for bolts are shown as circles in elements 2, 3 and 5, e.g., marked as (b) in upper brace 3. In the embodiment of FIGS. 1*a* and *b*, the shorter brace and longer brace are on opposite sides of the girder (6), as shown in FIG. 2. In such embodiments, the braces can be situated so that one or more of the holes (b) from one brace align with one or more of the holes of the opposite brace, so that through bolts, passing through both braces, i.e., the longer brace and the shorter brace, and the girder, can be used to anchor the girder to the pile cap. The longer brace remains available for connecting to the building above the girder. This connection, like any connection or attachment herein, can be by any standard means, e.g., bolts, nails, screws, adhesives and the like.

In embodiments, such as shown in FIGS. 5 and 6, more than one brace is long enough to rise above the girder and rest against the building above. In such cases, each of the long braces can be attached to the building, and may be aligned so that through bolts can be used to pass through each brace and the portion of the building. Typically, in such embodiments, each of the "long" braces is also attached to a girder, as discussed above.

In many cases two upper braces are sufficient, however, more than two upper braces may be used. While the embodiments of, e.g., FIGS. 1*a*, 1*b*, 5 and 6, are configured to accept the run of the girder, other embodiments may be configured to accept the end of a girder, and various angles and tees are also part of the present invention, e.g., FIG. 7.

Figure 8:
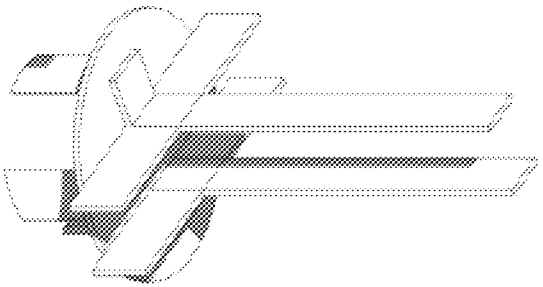
FIG. 8 shows a pile cap of the invention with long, horizontal extensions
Figure 9:
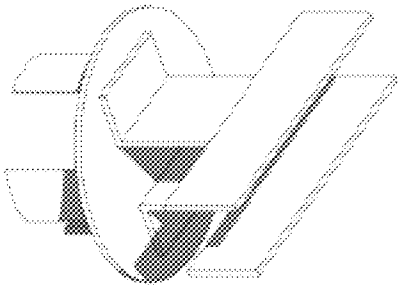
FIG. 9 shows another pile cap of the invention with long, horizontal extensions

There is no limitation on the shape of the upper braces. Angle braces or straight braces, i.e., flat plates, may be used. FIGS. 8 and 9 show that the upper braces may more complex shapes. Each upper brace may be constructed from a single piece or may be more than one piece fastened together by any of the means discussed above. Often, the upper braces are welded to the cap plate, but in various embodiments they can be bolted, fixed with an adhesive or attached by any other standard means.

The pile cap of the invention is made from any material, or materials, strong enough to perform the necessary functions, and which can be appropriately shaped, e.g., steel plate, aluminum, other metals, alloys, composites, including e.g., carbon reinforced polymers. In many embodiments, the cap plate, lower braces and upper braces are made from the same material, but this is not necessary.

Figure 3:
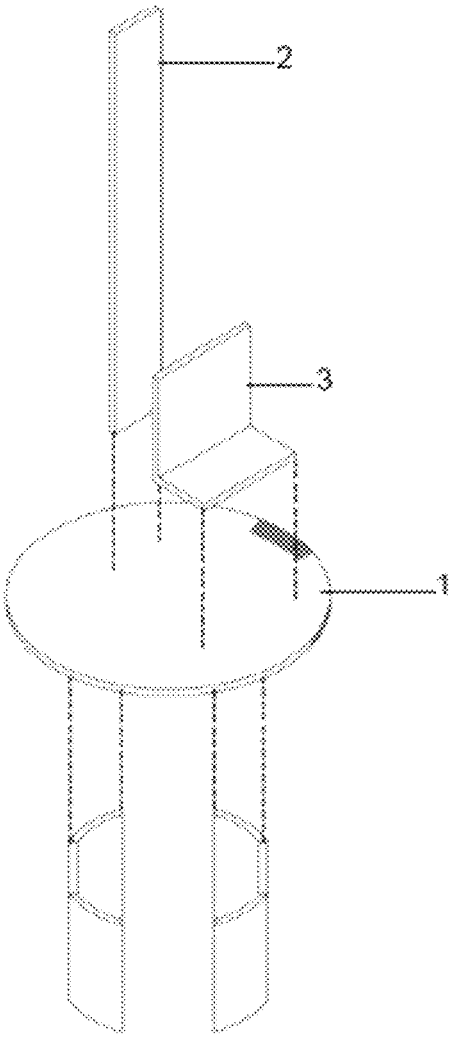
FIG. 3 is an exploded view of the pile cap of FIG. 1*a*

The lower braces are typically welded to the cap plate as are the upper braces. In many embodiments, the pile cap of the invention is conveniently assembled, at least in part, on site. FIG. 3 is an explosion view of the pile cap illustrating the various parts and location of placement. For example, in one embodiment, the cap plate and lower braces, already assembled as a single unit, are anchored to a pile, after which the upper braces are attached. The two or more upper braces need not be attached to the cap plate before being attached to the girder/building. This can happen in any order.

While it is certainly possible to attach the lower braces to the pile before affixing them to the cap plate, in most embodiments the lower braces are affixed to the cap plate prior to being brought to the site. When using a sleeve instead of the present lower braces, the interior of the sleeve is designed to be slightly larger than the pile so that it can slide over the pile. In the present invention, the lower braces can be cut from pipes, and if the pipe is slightly larger than the pile, a perfectly snug fit can be obtained. However, as the braces are merely sections of a pipe, and can be of various widths, the inner curvature of each brace is not nearly as important as when a single piece, round sleeve is used, creating a greater degree of flexibility for the inventive pile cap. In preferred embodiments, the pile cap has a plurality of lower braces attachable to the underside of the support plate and the pile pipe, e.g., 2, 4 or 6 lower braces, typically 4.

In the present drawings, the cap plate is shown as round, but it should be readily appreciated that other shapes are just as easily provided and can also be used. One reason why round cap plates are shown is that while not all piles are round, many piles in use today are round.

Pipe piles are commonly encountered, for example, round PGD piles made of steel casing pipe segments in 5 to 40 foot lengths with diameters of from 4 to 20 inches, e.g., from 4 to 16 inches or 8 to 16 inches, for example, 4.5 inches, 5.5 inches, 7 inches, 9.63 inches, 11.75 inches and 13.38 inches. The pile caps of the invention can be used with any of these piles, but other types and shapes are also readily accommodated with minor modifications that will be within the purview of one skilled in the art upon reading the present specification.

The manner in which the pieces of the pile cap are attached to each other need not be limited, nor is the manner in which the pile cap is attached to pile, girder, or building. This may depend on the type of building being constructed or retrofitted, the building material being used, the location of the building, etc. Just as the means of attachment need not limited, the manner in which the attachment means is employed need not be not limited. For example, when using a bolt or screw, etc., there is no limitation on the size, number or bolting pattern that may be employed.

The pile cap connectors of the present invention are particularly suitable for securing retrofitted elevated foundations to homes or other buildings that have been lifted and are to be placed onto and secured to elevated foundations, however, the pile cap connectors may be used for open site construction as well.

The pile cap connector may have one of several configurations and serves to connect the pipe pile to a support beam or girder for the house or building.

The height of the upper braces will depend on the support beam or girder. For example, FIG. 2 shows a pile cap of the invention atop a pile, with a laminated veneer lumber (LVL) support beam (6) between the upper braces of the pile cap. The cap has a shorter angle brace welded to the cap plate and a longer straight brace, also welded to the cap plate. For an LVL beam rising 14 inches from the cap plate, a longer brace taller than 14 inches from the cap plate would be needed, e.g., 18 inches in one embodiment, but an even longer brace or a slightly shorter brace may be used.

In one embodiment of the invention, the upper braces are made from ½ inch steel, however, the braces may have different thicknesses, and may be made of different materials, e.g., steel, stainless steel, aluminum, composites, etc. It should be understood that the size, shape, and the materials used in manufacture of the pile cap will likely vary depending on the type of building, e.g., residential, commercial, or industrial, etc., under construction or being retrofitted. The size of the building and specific location may also play a role in determining such factors.

For example, the cap plate is often circular, or disc shaped, and has a circumference large enough to cover the top of the pile, and is generally slightly larger relative to the other components than that shown in the figures. However, the cap plate can be shaped as oval, square, rectangular, or any other polygon etc., and can have a surface area of any convenient size. For example, for a pile with a diameter of about 12 inches, a round cap plate may have a diameter of about 12 to about 24 inches, e.g., from about 13 or 14 to about 20 inches, but in some embodiments, the cap plate may also have a larger diameter. Naturally, for a pile with a diameter of 16 inches, a round cap plate may have a diameter of from about 16 to about 30 inches, e.g., about 17 or 18 to about 16 inches. The thickness of the plate can be ½ inch, but it can be thicker or thinner if desired, or as needed depending on the demands of the building, e.g., from ¼ to 1 or 2 inches.

The lengths of the lower braces can also vary, but will generally be from 2 to 30 inches long, typically from 2 and 24 inches long, e.g., from about 4 to about 16 inches, such as 6, 8, 12, or 14 inches long. The width of the lower brace will vary depending on the circumference of the pile and the number of lower braces used, but the brace must be wide enough to successfully accommodate the means of fastening the cap to the pile. For example, for a pile with about a 12 inch diameter, a lower brace might be from 2 to 6 inches wide, typically from 3 to 5 inches wide, but pile caps for larger piles may use larger lower braces. In many embodiments, the thickness of the lower braces generally will be from about ⅛ to 1 inch, typically from ¼ to ¾ inch.

As discussed above, the dimensions of the upper braces will vary depending on the dimensions of the support beam or girder, also on the area of the upper face of the cap plate, and will often have a thickness of from ¼ to 1 or 2 inches.

It should be understood that the dimensions above reflect certain embodiments of the invention and the inventive pile cape can be adjusted to larger or smaller sizes. The overall shape of the upper braces, as well as the dimensions, can vary greatly, for example, In FIG. 4*a* the cap comprises a short broad angle brace and a tall straight brace that will reach past the girder and lay against the building above.

The cap of FIG. 5 comprises two angle braces each of which will reach past the girder and lay against the building above.

The cap of FIG. 6 comprises two tall straight braces each of which will reach past the girder and lay against the building above.

Figure 7:
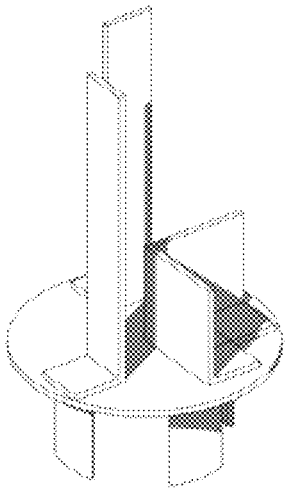
FIG. 7 shows a corner pile cap of the invention

The cap of FIG. 7 comprises two tall angle braces each of which will reach past the girder and lay against the building above opposed by two broad angle braces defining a corner.

The cap of FIG. 8 comprises two straight braces each of which will reach past the girder and lay against the building above, which braces are affixed to a lower horizontal cross-piece designed to lay against the girder.

The cap of FIG. 9 comprises two straight braces each of which will reach past the girder and lay against the building above, which braces are affixed to a lower horizontal cross-piece designed to lay against the girder.

Caps of the invention can be arranged to accept the run of a girder, or a corner or intersection of two or more girders.

Any materiality or gauge of materials strong enough to meet the demands of a pile cap connector, i.e., any material of sufficient strength to function under local conditions, can be used in the manufacture of the caps, e.g., aluminum, steel, stainless steel, wood, composites, etc. Likewise, any method of adhesion or attachment may be used to bind the parts of the pile cap either to other parts of the cap, the cap to the pile, or the cap to the girder or building, e.g., welding, glues, epoxy, bolts, screws, set screws, etc.

Other materials useful in aspects of the invention include, but are not limited to: steel, aluminum, other metals and metal alloys, composites, including aggregate composites, aluminum polymer composites, ceramic matrix composite, composite epoxy material, composite laminates, fiber reinforced thermoplastic, carbon fiber reinforced polymer, cross laminated timber, engineered wood, fiberglass, glass-filled polymer, glued laminated timber, graph-alloy, laminated veneer lumber, plywood, polymer matrix composite, reinforced carbon, wood-plastic composite.

In one example, a pile cap of the invention, e.g. see FIGS. 1-4*a*, is made and installed as follows:

The lower braces are welded to the cap plate, the resulting assembly is then position on the pile and bolted in place. The girder is then put in place atop the cap plate, the upper braces are fixed in place, typically by welding to the cap plate, after which the girder is bolted to the upper braces. The longer brace, or braces will be secured to the building proper when appropriate.

One skilled in the art will of course realize that variations to the above steps can be readily envisioned that will still provide the pile cap of the invention.

What is claimed is:

1. A building structure comprising a building proper, a girder for supporting the building proper and a pile cap, the pile cap comprising;

i) a cap plate having a top side and an underside, ii) lower braces affixed to the underside of the cap plate for attaching the cap plate to the pile; and iii) upper braces for securable disposition to the top side of the cap plate and wherein, when secured to the top side of the cap plate, at least one of the upper braces is a shorter brace having a length that extends no further than the distance needed to traverse the girder and at least one of the upper braces is a longer upper brace having a length greater than that needed to traverse the girder so that a portion of the longer upper brace lays against the building above the girder for fastening thereto, wherein the lower braces are anchored to the pile by one or more through bolts passing through a first one of the lower braces, the pile, and a second one of the lower braces opposite the first one of the lower braces, wherein two of the upper braces are anchored to the girder by one or more through bolts passing through a first one of said two upper braces, the girder and a second one of said two upper braces opposite the first one of said two upper braces, and at least one of the upper braces having a length greater than that needed to traverse the girder is fastened to the building proper.

2. The building structure according to claim 1 wherein the lower braces of the pile cap are manufactured by cutting sections from a pipe.

3. The building structure according to claim 2 wherein the cap plate, lower braces and upper braces of the pile cap are manufactured from a metal, metal alloy or metal composite.

4. The building structure according to claim 3 wherein the lower braces and the upper braces of the pile cap are attached to the cap plate by welds.

5. The building structure according to claim 1 wherein the cap plate, lower braces and upper braces of the pile cap are manufactured from a metal, metal alloy or metal composite.

6. The building structure according to claim 5 wherein the lower braces and the upper braces of the pile cap are attached to the cap plate by welds.

7. The building structure according to claim 1 wherein when one of the upper braces is a shorter brace, said shorter brace, when secured to the top side of the cap plate has a length that extends less than the distance needed to traverse the girder.

8. A method for installing a pile cap for connecting a top end of a foundation pile to both a girder for a building and to the building supported by the girder, into a building structure, the building structure comprising the pile cap, the building, and the girder for supporting the building, the pile cap comprising:

i) a cap plate having a top side and an underside, ii) lower braces affixed to the underside of the cap plate for attaching the cap plate to the pile; and iii) upper braces for securable disposition to the top side of the cap plate and to the girder supporting the building, the building supported by the girder, or both the girder and the building, wherein the pile cap comprises two or more upper braces and wherein, when secured to the top side of the cap plate, at least one of the upper braces is a shorter brace having a length that extends no further than the distance needed to traverse the girder and at least one of the upper braces is a longer upper brace having a length greater than that needed to traverse the girder so that a portion of the longer upper brace lays against the building for fastening thereto, the method comprising:

I) affixing one or more lower braces to the underside of the cap plate to form a lower assembly, II) anchoring the lower assembly to a pile, III) followed by securing the upper braces to the top side of the cap plate.

9. The method according to claim 8 wherein at least one upper brace is secured to the cap plate after the girder is in place.

* * * * *